US008650850B2

(12) United States Patent
Barguet et al.

(10) Patent No.: US 8,650,850 B2
(45) Date of Patent: Feb. 18, 2014

(54) THREE-LAYERED METAL CABLE FOR TIRE CARCASS REINFORCEMENT

(75) Inventors: Henri Barguet, Les Martres-d'Artiere (FR); Alain Domingo, Orleat (FR); Arnaud Letocart, Combronode (FR); Thibaud Pottier, Malauzat (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 13/550,763

(22) Filed: Jul. 17, 2012

(65) Prior Publication Data

US 2012/0298281 A1 Nov. 29, 2012

Related U.S. Application Data

(63) Continuation of application No. 12/794,010, filed on Jun. 4, 2010, now Pat. No. 8,245,490, which is a continuation of application No. 11/473,756, filed on Jun. 23, 2006, now abandoned, which is a continuation of application No. PCT/EP2004/014662, filed on Dec. 23, 2004.

(30) Foreign Application Priority Data

Dec. 24, 2003 (FR) ..... 03 15371

(51) Int. Cl.
*D02G 3/48* (2006.01)

(52) U.S. Cl.
USPC ..... 57/212

(58) Field of Classification Search
USPC ..... 57/212, 213, 217, 223, 230, 232
See application file for complete search history.

(56) References Cited

U.S. PATENT DOCUMENTS

| | | | |
|---|---|---|---|
| 2,181,475 | A | 11/1939 | Bourdon |
| 3,425,207 | A | 2/1969 | Cambell |
| 4,763,466 | A | 8/1988 | Abe et al. |
| 4,960,473 | A | 10/1990 | Kim et al. |
| 5,074,345 | A | 12/1991 | Penant |
| 5,139,874 | A | 8/1992 | Starinshak et al. |
| 5,223,060 | A | 6/1993 | Imamiya et al. |
| 5,595,057 | A | 1/1997 | Kuriya |
| 5,697,204 | A | 12/1997 | Kuriya |
| 6,021,633 | A | 2/2000 | Cipparrone et al. |
| 6,120,911 | A | 9/2000 | Beers et al. |

(Continued)

FOREIGN PATENT DOCUMENTS

| | | |
|---|---|---|
| EP | 0366475 A2 | 5/1990 |
| EP | 0536545 A1 | 4/1993 |

(Continued)

OTHER PUBLICATIONS

RD (Research Disclosure) No. 34370 "Steel cords of the 1+6+12-type", Published Nov. 1992.

*Primary Examiner* — Shaun R Hurley
(74) *Attorney, Agent, or Firm* — Fitzpatrick, Cella, Harper & Scinto

(57) ABSTRACT

In a multi-strand steel cable, at least three layers are present. An inner layer includes from 1 to 4 wires. An intermediate layer surrounds the inner layer and includes from 3 to 12 wires wound together in a helix at a pitch $p_2$. An outer layer surrounds the intermediate layer and includes from 8 to 20 wires wound together in a helix at a pitch $p_3$. A rubber sheath covers at least the intermediate layer and is formed of a cross-linkable or cross-linked rubber composition that includes at least one diene elastomer.

25 Claims, 2 Drawing Sheets

(56) References Cited

U.S. PATENT DOCUMENTS

| | | | |
|---|---|---|---|
| 6,322,907 | B1 | 11/2001 | Hauser et al. |
| 6,334,293 | B1 | 1/2002 | Poethke et al. |
| 6,418,994 | B1 | 7/2002 | Arnaud et al. |
| 6,667,110 | B1 | 12/2003 | Cordonnier et al. |
| 6,748,989 | B2 | 6/2004 | Cordonnier et al. |
| 6,766,841 | B2 | 7/2004 | Cordonnier et al. |
| 6,837,289 | B2 | 1/2005 | Cordonnier et al. |
| 7,152,391 | B2 | 12/2006 | Vanneste et al. |
| 7,228,681 | B2 | 6/2007 | Meersschaut et al. |
| 2002/0160213 | A1 | 10/2002 | Imamiya et al. |
| 2002/0189227 | A1 | 12/2002 | Roux et al. |
| 2003/0145936 | A1 | 8/2003 | Hrycyk et al. |
| 2004/0108038 | A1 | 6/2004 | Cordonnier et al. |
| 2005/0003185 | A1 | 1/2005 | Esnault et al. |
| 2005/0037197 | A1 | 2/2005 | Vanneste et al. |

FOREIGN PATENT DOCUMENTS

| | | | |
|---|---|---|---|
| EP | 0648891 | A1 | 4/1995 |
| EP | 0719889 | A1 | 7/1996 |
| EP | 0791682 | A1 | 8/1997 |
| EP | 0976541 | A1 | 2/2000 |
| EP | 1130053 | A2 | 9/2001 |
| JP | 47-40188 | B2 | 12/1972 |
| JP | 2-229287 | A | 9/1990 |
| JP | 2003-503605 | A | 1/2003 |
| WO | 98/41682 | A1 | 9/1998 |
| WO | 99/31313 | A1 | 6/1999 |
| WO | 03/048447 | A1 | 6/2003 |
| WO | 2005/014924 | A1 | 2/2005 |

THREE-LAYERED METAL CABLE FOR TIRE CARCASS REINFORCEMENT

CROSS-REFERENCE TO RELATED APPLICATIONS

This application is a continuation of U.S. application Ser. No. 12/794,010, filed on Jun. 4, 2010, which is a continuation of U.S. application Ser. No. 11/473,756, filed on Jun. 23, 2006, which is a continuation of International Application No. PCT/EP2004/014662, filed on Dec. 23, 2004, which claims priority to French Patent Application No. 03/15371, filed on Dec. 24, 2003, all of which are incorporated herein by reference in their entirety.

BACKGROUND OF THE INVENTION

1. Field of the Invention

The present invention relates to three-layered metal cables usable as reinforcement elements for articles made of rubber and/or plastics material.

It relates in particular to the reinforcement of tires, more particularly to the reinforcement of the carcass reinforcement of tires of industrial vehicles such as heavy vehicles.

2. Description of the Related Art

Steel cables ("steel cords") for tires, as a general rule, are formed of wires of perlitic (or ferro-perlitic) carbon steel, hereinafter referred to as "carbon steel", the carbon content of which (% by weight of steel) is generally between 0.1% and 1.2%, the diameter of these wires most frequently being between 0.10 and 0.40 mm (millimetres). A very high tensile strength is required of these wires, generally greater than 2000 MPa, preferably greater than 2500 MPa, which is obtained owing to the structural hardening which occurs during the phase of work-hardening of the wires. These wires are then assembled in the form of cables or strands, which requires the steels used also to have sufficient ductility in torsion to withstand the various cabling operations.

For reinforcing in particular carcass reinforcements of heavy-vehicle tires, nowadays most frequently what are called "layered" steel cables ("layered cords") or "multi-layer" steel cables formed of a central layer and one or more practically concentric layers of wires arranged around this central layer are used. These layered cables, which favour greater contact lengths between the wires, are preferred to the older "stranded" cables ("strand cords") owing firstly to greater compactness, and secondly to lesser sensitivity to wear by fretting. Among layered cables, a distinction is made in particular, in known manner, between compact-structured cables and cables having tubular or cylindrical layers.

The layered cables most widely found in the carcasses of heavy-vehicle tires are cables of the formula L+M or L+M+N, the latter generally being intended for the largest tires. These cables are formed in known manner of an inner layer of L wire(s), surrounded by a layer of M wires which itself is surrounded by an outer layer of N wires, with generally L varying from 1 to 4, M varying from 3 to 12 and N varying from 8 to 20; the assembly may possibly be wrapped by an external wrapping wire wound in a helix around the final layer.

In order to fulfil their function as reinforcement for tire carcasses, the layered cables must first of all have good flexibility and high endurance under flexion, which implies in particular that their wires are of relatively low diameter, preferably less than 0.28 mm, more preferably less than 0.25 mm, and generally smaller than that of the wires used in conventional cables for crown reinforcements of tires.

These layered cables are furthermore subjected to major stresses during travel of the tires, in particular to repeated flexure or variations in curvature, which cause friction at the level of the wires, in particular as a result of the contact between adjacent layers, and therefore wear, and also fatigue; they must therefore have high resistance to what is called "fatigue-fretting" phenomena.

Finally, it is important for them to be impregnated as much as possible with rubber, and for this material to penetrate into all the spaces between the wires forming the cables, because if this penetration is insufficient, there then form empty channels along the cables, and the corrosive agents, for example water, which are likely to penetrate into the tires for example as a result of cuts, move along these channels and into the carcass of the tire. The presence of this moisture plays an important part in causing corrosion and in accelerating the above degradation processes (what are called "fatigue-corrosion" phenomena), compared with use in a dry atmosphere.

All these fatigue phenomena which are generally grouped together under the generic term "fatigue-fretting-corrosion" are at the origin of gradual degeneration of the mechanical properties of the cables, and may adversely affect the life thereof under the very harshest running conditions.

In order to improve the endurance of layered cables in heavy-vehicle tire carcasses, in which in known manner the repeated flexural stresses may be particularly severe, it has for a long time been proposed to modify the design thereof in order to increase, in particular, their ability to be penetrated by rubber, and thus to limit the risks due to corrosion and to fatigue-corrosion.

There have for example been proposed layered cables of the construction 3+9+15 which are formed of an inner layer of 3 wires surrounded by an intermediate layer of 9 wires and an outer layer of 15 wires, the diameter of the wires of the central or inner layer being or not being greater than that of the wires of the other layers. These cables cannot be penetrated as far as the core owing to the presence of a channel or capillary at the centre of the three wires of the inner layer, which remains empty after impregnation by the rubber, and therefore favorable to the propagation of corrosive media such as water.

The publication RD (Research Disclosure) No. 34370 describes cables of the structure 1+6+12, of the compact type or of the type having concentric tubular layers, formed of an inner layer formed of a single wire, surrounded by an intermediate layer of 6 wires which itself is surrounded by an outer layer of 12 wires. The ability to be penetrated by rubber can be improved by using diameters of wires which differ from one layer to the other, or even within one and the same layer. Cables of construction 1+6+12, the penetration ability of which is improved owing to appropriate selection of the diameters of the wires, in particular to the use of a central wire of larger diameter, have also been described, for example in documents EP-A-648 891 (U.S. Pat. No. 6,418,994) or WO-A-98/41682 (U.S. Pat. No. 6,667,110).

In order to improve further, relative to these conventional cables, the penetration of the rubber into the cable, there have been proposed multilayer cables having a central layer surrounded by at least two concentric layers, for example cables of the formula 1+6+N, in particular 1+6+11, the outer layer of which is unsaturated (incomplete), thus ensuring better ability to be penetrated by rubber (see, for example, patent documents EP-A-719 889 (U.S. Pat. No. 5,697,204) and WO-A-98/41682 (U.S. Pat. No. 6,667,110). The proposed constructions make it possible to dispense with the wrapping wire, owing to better penetration of the rubber through the outer layer and the self-wrapping which results; however, experience shows that these cables are not penetrated right to the centre by the rubber, or in any case not yet optimally.

Furthermore, it should be noted that an improvement in the ability to be penetrated by rubber is not sufficient to ensure a sufficient level of performance. When they are used for reinforcing tire carcasses, the cables must not only resist corrosion, but also must satisfy a large number of sometimes contradictory criteria, in particular of tenacity, resistance to fretting, high degree of adhesion to rubber, uniformity, flexibility, endurance under repeated flexing or traction, stability under severe flexing, etc.

Thus, for all the reasons set forth previously, and despite the various recent improvements which have been made here or there on such and such a given criterion, the best cables used today in carcass reinforcements for heavy-vehicle tires remain limited to a small number of layered cables of highly conventional structure, of the compact type or the type having cylindrical layers, with a saturated (complete) outer layer; these are essentially cables of constructions 3+9+15 or 1+6+12 as described previously.

SUMMARY OF THE INVENTION

Now, the Applicants during their research discovered a novel layered cable which unexpectedly improves further the overall performance of the best layered cables known for reinforcing heavy-vehicle tire carcasses. This cable of the invention, owing to a specific structure, not only has excellent ability to be penetrated by rubber, limiting the problems of corrosion, but also has fatigue-fretting endurance properties which are significantly improved compared with the cables of the prior art. The longevity of heavy-vehicle tires and that of their carcass reinforcements is thus very substantially improved thereby.

Consequently, a first subject of the invention is a three-layered cable of construction L+M+N usable as a reinforcing element for a tire carcass reinforcement, comprising a inner layer (C1) of L wires of diameter $d_1$ with L being from 1 to 4, surrounded by at least one intermediate layer (C2) of M wires of diameter $d_2$ wound together in a helix at a pitch $p_2$ with M being from 3 to 12, said intermediate layer C2 being surrounded by an outer layer C3 of N wires of diameter $d_3$ wound together in a helix at a pitch $p_3$ with N being from 8 to 20, this cable being characterised in that a sheath formed of a cross-linkable or cross-linked rubber composition based on at least one diene elastomer covers at least said layer C2.

The invention also relates to the use of a cable according to the invention for reinforcing articles or semi-finished products made of plastics material and/or of rubber, for example plies, tubes, belts, conveyor belts and tires, more particularly tires intended for industrial vehicles which usually use a metal carcass reinforcement.

The cable of the invention is very particularly intended to be used as a reinforcing element for a carcass reinforcement for an industrial-vehicle tire, such as vans, "heavy vehicles"—i.e. subway trains, buses, road transport machinery (lorries, tractors, trailers), off-road vehicles—agricultural machinery or construction machinery, aircraft, and other transport or handling vehicles.

However, this cable of the invention could also be used, according to other specific embodiments of the invention, to reinforce other parts of tires, in particular belts or crown reinforcements of such tires, in particular of industrial tires such as heavy-vehicle or construction-vehicle tires.

The invention furthermore relates to these articles or semi-finished products made of plastics material and/or rubber themselves when they are reinforced by a cable according to the invention, in particular tires intended for the industrial vehicles mentioned above, more particularly heavy-vehicle tires, and also to composite fabrics comprising a matrix of rubber composition reinforced with a cable according to the invention, which are usable as a carcass or crown reinforcement ply for such tires.

BRIEF DESCRIPTION OF THE DRAWINGS

The invention and its advantages will be readily understood in the light of the description and examples of embodiment which follow, and FIGS. 1 to 3 relating to these examples, which reproduce or diagrammatically show, respectively.

DETAILED DESCRIPTION OF THE INVENTION

Air Permeability Test

Figure 1:
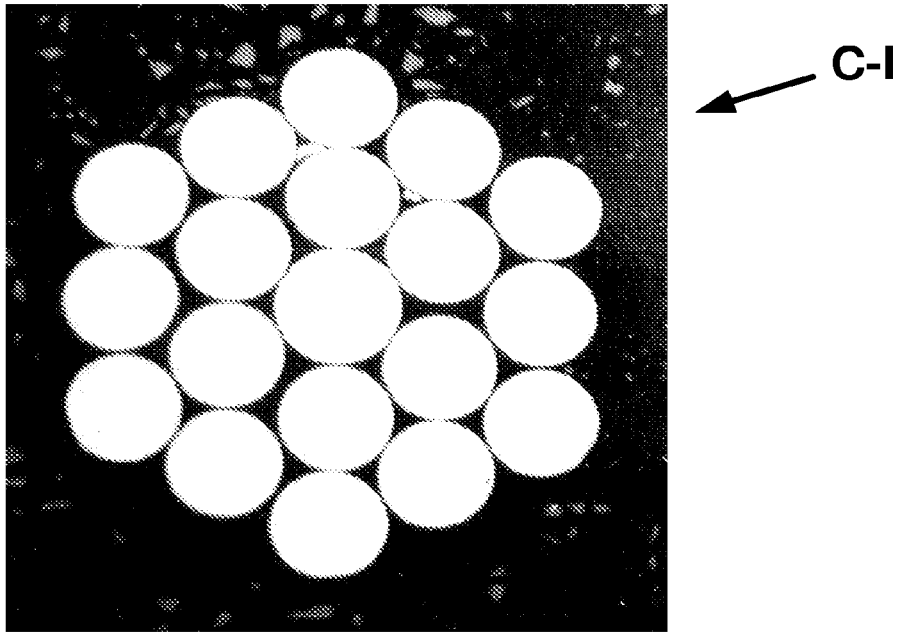
FIG. 1 is a photomicrograph (magnification ×40) of a cross-section through a control cable of construction 1+6+12.

The air permeability test is a simple way of indirectly measuring the amount of penetration of the cable by a rubber composition. It is performed on cables extracted directly, by decortication, from the vulcanised rubber plies which they reinforce, and which therefore have been penetrated by the cured rubber.

The test is carried out on a given length of cable (for example 2 cm) as follows: air is sent to the entry of the cable, at a given pressure (for example 1 bar), and the volume of air at the exit is measured, using a flow meter; during the measurement, the sample of cable is locked in a seal such that only the quantity of air passing through the cable from one end to the other, along its longitudinal axis, is taken into account by the measurement. The flow rate measured is lower, the higher the amount of penetration of the cable by the rubber.

Tests of Endurance in the Tire

The endurance of the cables under fatigue-fretting-corrosion is evaluated in carcass plies of heavy-vehicle tires by a very long-duration running test.

For this, heavy-vehicle tires are manufactured, the carcass reinforcement of which is formed of a single rubberised ply reinforced by the cables to be tested. These tires are mounted on suitable known rims and are inflated to the same pressure (with an excess pressure relative to the rated pressure) with air saturated with moisture. Then these tires are run on an automatic running machine under a very high load (overload relative to the rated load) and at the same speed, for a given number of kilometres. At the end of the running, the cables are extracted from the tire carcass by decortication, and the residual breaking load is measured both on the wires and on the cables thus fatigued.

Furthermore, tires identical to the previous ones are manufactured and they are decorticated in the same manner as previously, but this time without subjecting them to running. Thus the initial breaking load of the non-fatigued wires and cables is measured after decortication.

Finally, the degeneration of breaking load after fatigue is calculated (referred to as ΔFm and expressed in %), by comparing the residual breaking load with the initial breaking load. This degeneration ΔFm is due to the fatigue and wear (reduction in section) of the wires which are caused by the joint action of the various mechanical stresses, in particular the intense working of the contact forces between the wires, and the water coming from the ambient air, in other words to the fatigue-fretting corrosion to which the cable is subjected within the tire during running.

It may also be decided to perform the running test until forced destruction of the tire occurs, owing to a break in the carcass ply or another type of damage occurring earlier (for example destruction of the crown or detreading).

Cables of the Invention

The terms "formula" or "structure", when used in the present description to describe the cables, refer simply to the construction of these cables.

As indicated previously, the three-layered cable according to the invention, of construction L+M+N, comprises an inner layer C1 formed of L wires of diameter $d_1$, surrounded by an intermediate layer C2 formed of M wires of diameter $d_2$, which is surrounded by an outer layer C3 formed of N wires of diameter $d_3$.

According to the invention, a sheath made of a cross-linkable or cross-linked rubber composition comprising at least one diene elastomer covers at least said layer C2. It should be understood that the layer C1 could itself be covered with this rubber sheath.

The expression "composition comprising at least one diene elastomer" is understood to mean, in known manner, that the composition comprises this or these diene elastomer(s) in a majority proportion (i.e. in a mass fraction greater than 50%).

It will be noted that the sheath according to the invention extends continuously around said layer C2 which it covers (that is to say that this sheath is continuous in the "orthoradial" direction of the cable which is perpendicular to its radius), so as to form a continuous sleeve of a cross-section which is advantageously substantially circular.

It will also be noted that the rubber composition of this sheath is cross-linkable or cross-linked, that is to say that it by definition comprises a cross-linking system suitable to permit cross-linking of the composition upon the curing thereof (i.e., its hardening and not its melting); thus, this rubber composition may be referred to as unmeltable, because it cannot be melted by heating to any temperature whatever.

"Diene" elastomer or rubber is understood to mean, in known manner, an elastomer resulting at least in part (i.e. a homopolymer or a copolymer) from diene monomers (monomers bearing two double carbon-carbon bonds, whether conjugated or not).

The diene elastomers, in known manner, may be classed in two categories: those referred to as "essentially unsaturated" and those referred to as "essentially saturated". In general, "essentially unsaturated" diene elastomer is understood here to mean a diene elastomer resulting at least in part from conjugated diene monomers, having a content of members or units of diene origin (conjugated dienes) which is greater than 15% (mol %). Thus, for example, diene elastomers such as butyl rubbers or copolymers of dienes and of alpha-olefins of the EPDM type do not fall within the preceding definition, and may in particular be described as "essentially saturated" diene elastomers (low or very low content of units of diene origin which is always less than 15%). Within the category of "essentially unsaturated" diene elastomers, "highly unsaturated" diene elastomer is understood to mean in particular a diene elastomer having a content of units of diene origin (conjugated dienes) which is greater than 50%.

These definitions being given, the following are understood more particularly to be meant by diene elastomer capable of being used in the cable of the invention:

(a) any homopolymer obtained by polymerisation of a conjugated diene monomer having 4 to 12 carbon atoms;

(b) any copolymer obtained by copolymerisation of one or more conjugated dienes together or with one or more vinyl-aromatic compounds having 8 to 20 carbon atoms;

(c) a ternary copolymer obtained by copolymerisation of ethylene, of an α-olefin having 3 to 6 carbon atoms with a non-conjugated diene monomer having 6 to 12 carbon atoms, such as, for example, the elastomers obtained from ethylene, from propylene with a non-conjugated diene monomer of the aforementioned type, such as in particular 1,4-hexadiene, ethylidene norbornene or dicyclopentadiene;

(d) a copolymer of isobutene and isoprene (butyl rubber), and also the halogenated, in particular chlorinated or brominated, versions of this type of copolymer.

Although it applies to any type of diene elastomer, the present invention is used first and foremost with essentially unsaturated diene elastomers, in particular those of type (a) or (b) above.

Thus the diene elastomer is preferably selected from among the group consisting of polybutadienes (BR), natural rubber (NR), synthetic polyisoprenes (IR), the various butadiene copolymers, the various isoprene copolymers and mixtures of these elastomers. Such copolymers are more preferably selected from among the group consisting of butadiene/styrene copolymers (SBR), isoprene/butadiene copolymers (BIR), isoprene/styrene copolymers (SIR) and isoprene/butadiene/styrene copolymers (SBIR).

More preferably, in particular when the cables of the invention are intended to reinforce tires, in particular carcass reinforcements of tires for industrial vehicles such as heavy vehicles, the diene elastomer selected is majoritarily (that is to say to more than 50 phr) constituted of a isoprene elastomer. "Isoprene elastomer" is understood to mean, in known manner, an isoprene homopolymer or copolymer, in other words a diene elastomer selected from among the group consisting of natural rubber (NR), synthetic polyisoprenes (IR), the various isoprene copolymers and mixtures of these elastomers.

According to one advantageous embodiment of the invention, the diene elastomer selected is exclusively (that is to say to 100 phr) constituted of natural rubber, synthetic polyisoprene or a mixture of these elastomers, the synthetic polyisoprene having a content (mole %) of cis-1,4 bonds preferably greater than 90%, more preferably still greater than 98%.

There could also be used, according to one particular embodiment of the invention, blends (mixtures) of this natural rubber and/or these synthetic polyisoprenes with other highly unsaturated diene elastomers, in particular with SBR or BR elastomers as mentioned above.

The rubber sheath of the cable of the invention may contain a single or several diene elastomer(s), the latter possibly being used in association with any type of synthetic elastomer other than a diene elastomer, or even with polymers other than elastomers, for example thermoplastic polymers, these polymers other than elastomers then being present as minority polymer.

Although the rubber composition of said sheath is preferably devoid of any plastomer and it comprises only one diene elastomer (or mixture of diene elastomers) as polymeric base, said composition might also comprise at least one plastomer in a mass fraction $x_p$ less than the mass fraction $x_e$ of the elastomer(s).

In such a case, preferably the following relationship applies: $0<x_p<0.5.\ x_e$.

More preferably, in such a case the following relationship applies: $0<x_p<0.1.\ x_e$.

Preferably, the cross-linking system for the rubber sheath is what is called a vulcanisation system, that is to say one based on sulphur (or a sulphur donor) and a primary vulcanisation accelerator. Various known secondary accelerators or vulcanisation activators may be added to this base vulcanisation system. The sulphur is used in a preferred amount of between 0.5 and 10 phr, more preferably of between 1 and 8 phr, the primary vulcanisation accelerator, for example a sulphenamide, is used in a preferred amount of between 0.5 and 10 phr, more preferably between 0.5 and 5.0 phr.

The rubber composition of the sheath according to the invention comprises, in addition to said cross-linking system, all the usual ingredients usable in rubber compositions for tires, such as reinforcing fillers based on carbon black and/or a reinforcing inorganic filler such as silica, anti-ageing agents, for example antioxidants, extender oils, plasticisers or agents which facilitate processing of the compositions in the uncured state, methylene acceptors and donors, resins, bismaleimides, known adhesion-promoting systems of the type "RFS" (resorcinol/formaldehyde/silica) or metal salts, in particular cobalt salts.

Preferably, the composition of the rubber sheath has, when cross-linked, a secant tensile modulus M10, measured in accordance with Standard ASTM D 412 of 1998, which is less than 20 MPa and more preferably less than 12 MPa, in particular between 4 and 11 MPa.

Preferably, the composition of this sheath is selected to be substantially identical to the composition used for the rubber matrix which the cables according to the invention are intended to reinforce. Thus there is no problem of possible incompatibility between the respective materials of the sheath and of the rubber matrix. Preferably, the rubber matrix has, in the cross-linked state, a secant tensile modulus that is less than 20 MPa, more preferably, the secant tensile modulus of the rubber matrix is less than 12 MPa.

Preferably, said composition comprises natural rubber and comprises carbon black as reinforcing filler, for example a carbon black of grade (ASTM) 300, 600 or 700 (for example N326, N330, N347, N375, N683, N772).

In the cable according to the invention, preferably at least one, more preferably still all, of the following characteristics are satisfied:

- the layer C3 is a saturated layer, that is to say that there is insufficient space in this layer to add at least one (N+1)th wire of diameter $d_2$, N then representing the maximum number of wires which can be wound in a layer around the layer C2;
- the rubber sheath furthermore covers the inner layer C1 and/or separates the adjacent wires M of the intermediate layer C2;
- the rubber sheath covers practically the radially inner half-circumference of each wire N of the layer C3, such that it separates the adjacent wires N of this layer C3.

In the construction L+M+N according to the invention, the intermediate layer C2 preferably comprises six or seven wires, and the cable in accordance with the invention then has the following preferred characteristics ($d_1$, $d_2$, $d_3$, $p_2$ and $p_3$ in mm):

(i) $0.10<d_1<0.28$;
(ii) $0.10<d_2<0.25$;
(iii) $0.10<d_3<0.25$;
(iv) M=6 or M=7;
(v) $5\pi(d_1+d_2)<p_2\leq p_3<5\pi(d_1+2d_2+d_3)$;
(vi) the wires of said layers C2, C3 are wound in the same direction of twist (S/S or Z/Z).

Preferably, the characteristic (v) is such that $p_2=p_3$, such that the cable is said to be compact, furthermore considering the characteristic (vi) (wires of the layers C2 and C3 wound in the same direction).

It will be recalled here that, according to a known definition, the pitch represents the length, measured parallel to the axis O of the cable, at the end of which a wire having this pitch makes a complete turn around the axis O of the cable; thus, if the axis O is sectioned by two planes perpendicular to the axis O and separated by a length equal to the pitch of a wire of one of the two layers C2 or C3, the axis of this wire has in these two planes the same position on the two circles corresponding to the layer C2 or C3 of the wire in question.

According to characteristic (vi), all the wires of the layers C2 and C3 are wound in the same direction of twist, that is to say either in the S direction ("S/S" arrangement), or in the Z direction ("Z/Z" arrangement). Winding the layers C2 and C3 in the same direction advantageously makes it possible, in the cable according to the invention, to minimise the friction between these two layers C2 and C3 and therefore the wear of the wires constituting them (since there is no longer any crossed contact between the wires).

Figure 2:
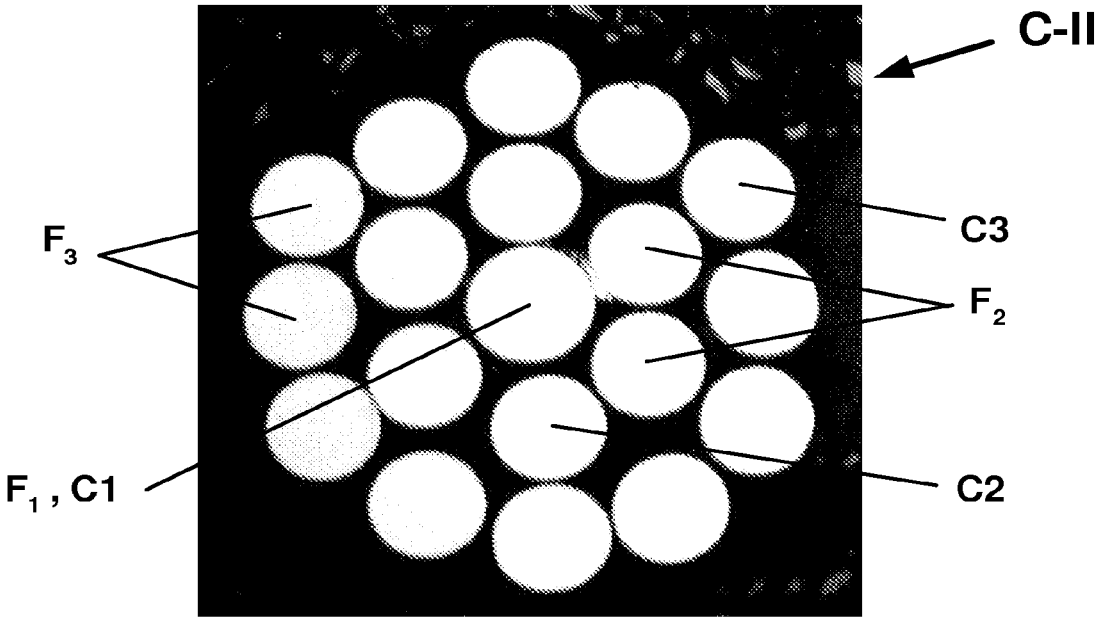
FIG. 2 is a photomicrograph (magnification ×40) of a cross-section through a cable according to the invention of construction 1+6+12.

It will be noted that despite the compact nature (pitch and direction of twist identical for layers C2 and C3) of the preferred cable of the invention, the layer C3 has a practically circular cross-section owing to the incorporation of said sheath, as illustrated by FIG. 2. In fact, it can easily be confirmed from this FIG. 2 that the coefficient of variation CV, defined by the ratio (standard deviation/arithmetic mean) of the respective radii of the N wires of the layer C3 measured from the longitudinal axis of symmetry of the cable, is very much reduced.

Now, in the compact layered cables, for example of construction 1+6+12, the compactness is such that the cross-section of such cables has a contour which is practically polygonal, as illustrated for example by FIG. 1, in which the aforementioned coefficient of variation CV is substantially higher.

Preferably, the cable of the invention is a layered cable of construction 1+M+N, that is to say that its inner layer C1 is formed of a single wire, as shown in FIG. 2.

In the cable of the invention, the ratios ($d_1/d_2$) are preferably set within given limits, according to the number M (6 or 7) of wires of the layer C2, as follows:

for M=6: $1.10<(d_1/d_2)<1.40$;
for M=7: $1.40<(d_1/d_2)<1.70$.

Too low a value of the ratio may be unfavourable to the wear between the inner layer and the wires of layer C2. Too high a value may for its part adversely affect the compactness of the cable, for a level of resistance which is finally not greatly modified, and its flexibility; the increased rigidity of the inner layer C1 due to an excessively large diameter $d_1$ might furthermore be unfavourable to the feasibility itself of the cable during the cabling operations.

The wires of layers C2 and C3 may have a diameter which is identical or different from one layer to the other. Preferably wires of the same diameter ($d_2=d_3$) are used, in particular to simplify the cabling process and to reduce the costs.

The maximum number $N_{max}$ of wires which can be wound in a single saturated layer C3 around the layer C2 is of course a function of numerous parameters (diameter $d_2$ of the inner layer, number M and diameter $d_2$ of the wires of layer C2, diameter $d_3$ of the wires of layer C3).

The invention is preferably implemented with a cable selected from among cables of the structure 1+6+10, 1+6+11, 1+6+12, 1+7+11, 1+7+12 or 1+7+13.

The invention is more preferably implemented, in particular in the carcasses of heavy-vehicle tires, with cables of structure 1+6+12.

For a better compromise between strength, feasibility and flexural strength of the cable on one hand and ability to be penetrated by rubber on the other hand, it is preferred that the diameters of the wires of the layers C2 and C3, whether identical or not, be between 0.14 mm and 0.22 mm.

In such a case, more preferably the following relationships are satisfied:

$$0.18<d_1<0.24;$$

$$0.16<d_2\leq d_3<0.19;$$

$$5<p_2\leq p_3<12 \text{ (low pitches in mm) or alternatively } 20<p_2\leq p_3<30 \text{ (high pitches in mm).}$$

In fact, for carcass reinforcements for heavy-vehicle tires, the diameters $d_2$ and $d_3$ are preferably selected between 0.16 and 0.19 mm: a diameter less than 0.19 mm makes it possible to reduce the level of the stresses to which the wires are subjected upon major variations in curvature of the cables, whereas preferably diameters greater than 0.16 mm will be selected for reasons in particular of strength of the wires and of industrial costs.

One advantageous embodiment consists, for example, of selecting $p_2$ and $p_3$ to be between 8 and 12 mm, advantageously with cables of structure 1+6+12.

Preferably, the rubber sheath has an average thickness of from 0.010 mm to 0.040 mm.

Generally, the invention may be implemented with any type of metal wires, in particular steel wires, for example carbon steel wires and/or stainless steel wires. Preferably a carbon steel is used, but it is of course possible to use other steels or other alloys.

When a carbon steel is used, its carbon content (% by weight of steel) is preferably between 0.1% and 1.2%, more preferably from 0.4% to 1.0%; these contents represent a good compromise between the mechanical properties required for the tire and the feasibility of the wire. It should be noted that a carbon content of between 0.5% and 0.6% ultimately makes such steels less expensive because they are easier to draw. Another advantageous embodiment of the invention may also consist, depending on the intended applications, of using steels having a low carbon content of for example between 0.2% and 0.5%, owing in particular to lower costs and greater ease of drawing.

When the cables of the invention are used to reinforce tire carcasses for industrial vehicles, their wires preferably have a tensile strength greater than 2000 MPa, more preferably greater than 3000 MPa. In the case of tires of very large dimensions, in particular wires having a tensile strength of between 3000 MPa and 4000 MPa will be selected. The person skilled in the art will know how to manufacture carbon steel wires having such strength, by adjusting in particular the carbon content of the steel and the final work-hardening ratios ($\epsilon$) of these wires.

The cable of the invention might be provided with an external wrap, formed for example of a single wire, whether or not of metal, wound in a helix about the cable in a pitch shorter than that of the outer layer, and a direction of winding opposite or identical to that of this outer layer.

However, owing to its specific structure, the cable of the invention, which is already self-wrapped, does not generally require the use of an external wrapping wire, which advantageously solves the problems of wear between the wrap and the wires of the outermost layer of the cable.

However, if a wrapping wire is used, in the general case in which the wires of layer C3 are made of carbon steel, advantageously a wrapping wire of stainless steel may then be selected in order to reduce the wear by fretting of these carbon steel wires in contact with the stainless steel wrap, as taught by patent document WO-A-98/41682 (U.S. Pat. No. 6,667,110), the stainless steel wire possibly being replaced in equivalent manner by a composite wire, only the skin of which is of stainless steel and the core of which is of carbon steel, as described for example in patent document EP-A-976 541 (U.S. Pat. No. 6,322,907). It is also possible to use a wrap formed from a polyester or a thermotropic aromatic polyesteramide, such as described in patent document WO-A-03/048447 (U.S. Published Patent Application No. 2005/0003185).

The cable according to the invention can be obtained by different techniques known to the person skilled in the art, for example in two stages, first of all by sheathing by means of an extrusion head of the core or intermediate structure L+M (layers C1+C2), which stage is followed in a second phase by a final operation of cabling or twisting the remaining N wires (layer C3) around the layer C2 thus sheathed. The problem of tack in the uncured state caused by the rubber sheath during any intermediate winding and unwinding operations may be solved in known manner by the person skilled in the art, for example by using an inserted film of plastics material.

Tires of the Invention

Figure 3:
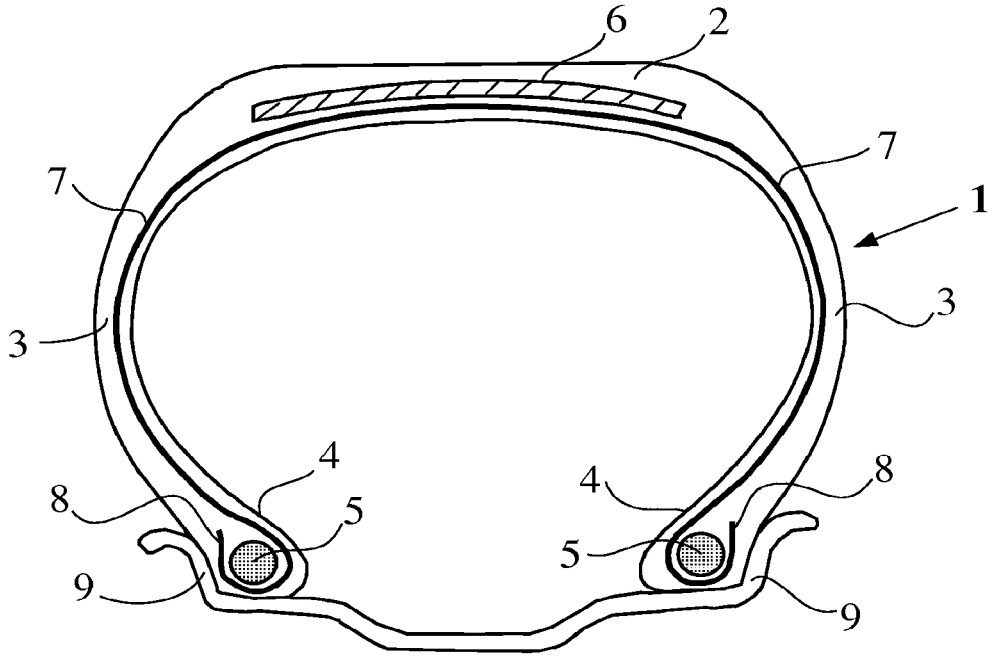
FIG. 3 is a radial section through a heavy-vehicle tire having a radial carcass reinforcement, whether or not in accordance with the invention in this general representation.

By way of example, FIG. 3 shows diagrammatically a radial section through a heavy-vehicle tire 1 having a radial carcass reinforcement which may or may not be in accordance with the invention, in this general representation.

This tire 1 comprises a crown 2, two sidewalls 3 and two beads 4 in which a carcass reinforcement 7 is anchored. The crown 2, surmounted by a tread (for simplification, not shown in FIG. 3) which is joined to said beads 4 by the two sidewalls 3, is in a manner known per se reinforced by a crown reinforcement 6 formed for example of at least two superposed crossed plies reinforced by known metal cables. The carcass reinforcement 7, which is radially surmounted by the crown reinforcement 6, here is anchored within each bead 4 by winding around two bead wires 5, the upturn 8 of this reinforcement 7 being for example arranged towards the outside of the tire 1 which is shown here mounted on its rim 9. The carcass reinforcement 7 is formed of at least one ply reinforced by what are called "radial" cables, that is to say that these cables are arranged practically parallel to each other and extend from one bead to the other so as to form an angle of between 80° and 90° with the median circumferential plane (plane perpendicular to the axis of rotation of the tire which is located halfway between the two beads 4 and passes through the centre of the crown reinforcement 6).

Of course, this tire 1 furthermore comprises in known manner an internal rubber or elastomer layer (commonly referred to as "internal rubber") which defines the radially inner face of the tire and which is intended to protect the carcass ply from the diffusion of air coming from the interior of the tire. Advantageously, it furthermore comprises an intermediate elastomer reinforcement layer which is located between the carcass ply and the inner layer, intended to reinforce the inner layer and, consequently, the carcass reinforcement, and also intended partially to delocalise the forces to which the carcass reinforcement is subjected.

The tire according to the invention is characterised in that its carcass reinforcement 7 comprises at least one carcass ply, the radial cables of which are three-layered cables according to the invention.

In this carcass ply, the density of the cables according to the invention is preferably between 40 and 100 cables per dm (decimetre) of radial ply, more preferably between 50 and 80 cables per dm, the distance between two adjacent radial cables, from axis to axis, thus being preferably between 1.0 and 2.5 mm, more preferably between 1.25 and 2.0 mm. The cables according to the invention are preferably arranged such that the width ("Lc") of the rubber bridge, between two adjacent cables, is between 0.35 and 1 mm. This width "Lc" in known manner represents the difference between the calendering pitch (laying pitch of the cable in the rubber fabric) and the diameter of the cable. Below the minimum value indicated, the rubber bridge, which is too narrow, risks mechanically degrading during working of the ply, in particular during the deformation which it experiences in its own plane by extension or shearing. Beyond the maximum indicated, there are risks of flaws in appearance occurring on the sidewalls of the tires or of penetration of objects, by perforation, between the cables. More preferably, for these same reasons, the width "Lc" is selected to be between 0.5 and 0.8 mm.

Preferably, the rubber composition used for the fabric of the carcass ply has, when vulcanised, (i.e. after curing) a secant tensile modulus M10 which is less than 20 MPa, more preferably less than 12 MPa, in particular between 5 and 11 MPa. It is in such a range of moduli that the best compromise of endurance between the cables of the invention on one hand and the fabrics reinforced by these cables on the other hand has been recorded.

EXAMPLES

Example 1

Nature and Properties of the Wires Used

To produce the examples of cables whether or not in accordance with the invention, fine carbon steel wires are used which are prepared in accordance with known methods, starting from commercial wires, the initial diameter of which is approximately 1 mm. The steel used is for example a known carbon steel (standard USA AISI 1069), the carbon content of which is 0.70%.

The commercial starting wires first undergo a known degreasing and/or pickling treatment before their later working. At this stage, their tensile strength is equal to about 1150 MPa, and their elongation at break is approximately 10%. Then copper is deposited on each wire, followed by a deposit of zinc, electrolytically at ambient temperature, and then the wire is heated thermally by Joule effect to 540° C. to obtain brass by diffusion of the copper and zinc, the weight ratio (phase $\alpha$)/(phase $\alpha$+phase $\beta$) being equal to approximately 0.85. No heat treatment is performed on the wire once the brass coating has been obtained.

Then so-called "final" work-hardening is effected on each wire (i.e. after the final heat treatment), by cold-drawing in a wet medium with a drawing lubricant which is in the form of an emulsion in water. This wet drawing is effected in known manner in order to obtain the final work-hardening ratio ($\epsilon$), calculated from the initial diameter indicated above for the commercial starting wires.

By definition, the ratio of a work-hardening operation, $\epsilon$, is given by the formula $\epsilon = \mathrm{Ln}\,(S_i/S_f)$, in which Ln is the natural logarithm, $S_i$ represents the initial section of the wire before this work-hardening and $S_f$ the final section of the wire after this work-hardening.

By adjusting the final work-hardening ratio, thus two groups of wires of different diameters are prepared, a first group of wires of average diameter $\phi$ equal to approximately 0.200 mm ($\epsilon$=3.2) for the wires of index 1 (wires marked F1) and a second group of wires of average diameter $\phi$ equal to approximately 0.175 mm ($\epsilon$=3.5) for the wires of index 2 or 3 (wires marked F2 or F3).

The brass coating which surrounds the wires is of very low thickness, significantly less than one micrometre, for example of the order of 0.15 to 0.30 μm, which is negligible compared with the diameter of the steel wires. Of course, the composition of the steel of the wire in its different elements (for example C, Mn, Si) is the same as that of the steel of the starting wire.

It will be recalled that during the process of manufacturing the wires, the brass coating facilitates the drawing of the wire, as well as the sticking of the wire to the rubber. Of course, the wires could be covered with a fine metal layer other than brass, having for example the function of improving the corrosion resistance of these wires and/or the adhesion thereof to the rubber, for example a fine layer of Co, Ni, Zn, Al, or of an alloy of two or more of the compounds Cu, Zn, Al, Ni, Co, Sn.

Example 2

Production of the Cables

Example 2.1

Cables C-I and C-II

The above wires are then assembled in the form of layered cables of structure 1+6+12 for the control cable of the prior art (FIG. 1) and for the cable according to the invention (FIG. 2); the wires F1 are used to form the layer C1, and the wires F2 and F3 to form the layers C2 and C3 of these various cables.

Each cable in this example of embodiment is devoid of wrap; it has the following properties (d and p in mm):

structure 1+6+12;

$d_1$=0.200 (mm);

$(d_1/d_2)$=1.14;

$d_2=d_3$=0.175 (mm);

$p_2=p_3$=10 (mm).

The wires F2 and F3 of layers C2 and C3 are wound in the same direction of twist (Z direction). The two types of cable (control cable C-I and cable of the invention C-II) are therefore distinguished by the sole fact that in the cable C-II of the invention, the central core formed by the layers C1 and C2 (structure 1+6) has been sheathed by a rubber composition based on non-vulcanised diene elastomer (in the uncured state).

The cable C-II according to the invention was obtained in several stages, firstly by producing an intermediate 1+6 cable, then by sheathing via an extrusion head of this intermediate cable, finally followed by a final operation of cabling the remaining 12 wires around the layer C2 thus sheathed. To avoid the problem of "tack in the uncured state" of the rubber sheath, an inserted film of plastics material (PET) was used during the intermediate winding and unwinding operations.

As can be seen clearly in FIG. 2, in comparison with FIG. 1, the layer C3 is spaced apart from the layer C2 owing to the sheathing of the latter; the inner layer C1 is also sheathed (since it is visibly spaced apart from the layer C2), solely due to the penetration of the rubber between the wires of the layer C2.

The elastomeric composition constituting the rubber sheath has the same formulation, based on natural rubber and carbon black, as that of the carcass reinforcement ply which the cables are intended to reinforce.

Example 2.2

Cables C-III and C-IV

Other cables were manufactured for supplementary comparative tests, by modifying the amount of carbon (0.58% instead of 0.70%). The cables thus obtained, the control cable and the cable in accordance with the invention, are marked C-III and C-IV respectively. In one variant embodiment of the cable C-IV (C-IVbis), furthermore the layer C1 (central wire) was itself rubberised before the core formed of the layers C1 and C2 was rubberised, and it was observed that the two types of cable (C-IV and CIV-bis) produced equivalent results.

Example 3

Endurance in the Tire

The above three-layered cables are then incorporated by calendering in composite fabrics formed of a known composition based on natural rubber and carbon black as reinforcing filler, used conventionally for the manufacture of carcass plies for radial heavy-vehicle tires. This composition essentially comprises, in addition to the elastomer and the reinforcing filler, an antioxidant, stearic acid, an extender oil, cobalt naphthenate as adhesion promoter, and finally a vulcanisation system (sulphur, accelerator, ZnO).

The composite fabrics reinforced by these cables comprise a rubber matrix formed of two fine layers of rubber which are superposed on either side of the cables and which each have a thickness of 0.75 mm. The calendering pitch (laying pitch of the cables in the rubber fabric) is 1.5 mm for both types of cable.

Example 3.1

Testing of Cables C-I and C-II

Two series of running tests for heavy-vehicle tires (designated P-I and P-II) of dimension 315/70 R 22.5 XZA were carried out, with in each series tires intended for running, and others for decortication on a new tire.

The carcass reinforcement of these tires is formed of a single radial ply formed of the rubberised fabrics described above.

The tires P-I are reinforced by the cables C-I and constitute the control tires of the prior art, whereas the tires P-II are the tires in accordance with the invention reinforced by the cables C-II. These tires are therefore identical with the exception of the layered cables which reinforce their carcass reinforcements 7.

Their crown reinforcement 6, in particular, is in known manner formed of two triangulation half-plies reinforced with metal cables inclined at 65 degrees, surmounted by two crossed superposed working plies, reinforced with inextensible metal cables which are inclined at 26 degrees (radially inner ply) and 18 degrees (radially outer ply), these two working plies being covered by a protective crown ply reinforced with elastic metal cables (high elongation) inclined at 18 degrees. In each of these crown reinforcement plies, the metal cables used are known conventional cables, which are arranged substantially parallel to each other, and all the angles of inclination indicated are measured relative to the median circumferential plane.

The tires P-I are tires sold by the Applicant for heavy vehicles and, owing to their recognised performance, constitute a control of choice for this test.

These tires are subjected to a severe running test such as is described in section I-2, with the test being performed until forced destruction of the tires tested occurs.

It will then be noted that the control tires P-I, under the very severe conditions of travel which are imposed thereon, are destroyed after an average distance of 232,000 km, following breaking of the carcass ply (numerous cables C-I broken in the bottom zone of the tire). This illustrates for the person skilled in the art the already very high performance of the control tires; such a mileage travelled is equivalent to continuous travel of close to 8 months approximately and to close to 80 million fatigue cycles.

However, unexpectedly, the tires P-II in accordance with the invention exhibit distinctly superior endurance, with an average distance travelled of close to 400,000 km, or a gain in endurance of approximately 70%.

Furthermore, it will be observed that the destruction of the tires of the invention takes place not at the level of the carcass reinforcement which continues to be strong, but in the crown reinforcement, which illustrates the excellent performance of the cables according to the invention.

After running, decortication is effected, that is to say extraction of the cables from the tires. The cables are then subjected to tensile tests, by measuring each time the initial breaking load (cable extracted from the new tire) and the residual breaking load (cable extracted from the tire after running) of each type of wire, according to the position of the wire in the cable, and for each of the cables tested. Only the control cables C-I which are not broken during travel are taken into account for this test.

The average deterioration ΔFm is given in % in Table 1 below; it is calculated both for the cords of the inner layer C1 and for the cords of layers C2 and C3. The overall degenerations ΔFm are also measured on the cables themselves.

TABLE 1

| | | ΔFm (%) on individual layers and cable | | | |
|---|---|---|---|---|---|
| Tires | Cables | C1 | C2 | C3 | Cable |
| P-I | C-I | 38 | 30 | 12 | 19 |
| P-II | C-II | 9 | 6 | 2 | 3.5 |

On reading Table 1, it will be noted that, whatever the zone of the cable which is analysed (layer C1, C2 or C3), by far the best results are recorded on the cables C-II according to the invention: it will be observed in particular that the further one penetrates into the cable (layers C3, C2 then C1), the greater the degeneration ΔFm, that of the cable according to the invention being 4 to 6 times less than that of the control cable, depending on the layer C1, C2 or C3 considered.

Finally and above all, the cable according to the invention C-II which has nevertheless endured for a very distinctly greater distance travelled, reveals an overall wear (ΔFm) which is five to six times less than that of the control cable (3.5% instead of 19%).

Correlatively to these results, visual examination of the various wires shows that the phenomena of wear or fretting (erosion of material at the points of contact), which result from repeated friction of the wires on each other, are substantially reduced in the cables C-II compared with the cables C-I.

In summary, the use of the cable C-II according to the invention makes it possible quite significantly to increase the life of the carcass, which is moreover already excellent in the control tire.

The endurance results described above furthermore appear to be very well correlated to the amount of penetration of the cables by the rubber, as explained hereafter.

The non-fatigued cables C-I and C-II (after extraction from the new tires) were subjected to the air permeability test described in section I-1, by measuring the volume of air (in $cm^3$) passing through the cables in 1 minute (average of 10 measurements).

Table 2 below shows the results obtained, in terms of average flow rate of air (average of 10 measurements—in relative units base 100 on the control cables) and of number of measurements corresponding to a zero air flow rate.

TABLE 2

| Cable | average flow rate of air (relative units) | Number of measurements at zero flow rate |
|---|---|---|
| C-I | 100 | 0/10 |
| C-II | 6 | 9/10 |

It will be noted that the cables C-II of the invention are those which, by very far, have the lowest air permeability (average flow rate of air zero or practically zero) and, consequently, the highest amount of penetration by the rubber.

The cables according to the invention, which are rendered impermeable by the rubber sheath which covers their intermediate layer C2 (and the inner layer C1), are thus protected from the flows of oxygen and humidity which pass for example from the sidewalls or the tread of the tires towards the zones of the carcass reinforcement, where the cables in known manner are subjected to the most intense mechanical working.

Example 3.2

Testing of Cables C-III and C-IV

In a second test, new heavy-vehicle tires of the same dimension (315/70 R 22.5 XZA) as previously were manufactured, this time using cables C-III and C-IV, then these tires (P-III and P-IV, respectively) were subjected to the same endurance test as previously.

The control tires (designated P-III), under these extreme travelling conditions, covered an average distance of 250,000 km, with at the end a deformation of their bead zone due to the beginning of rupture of the control cables (designated C-III) in said zone.

Under the same conditions, the tires in accordance with the invention (designated P-IV) revealed distinctly improved endurance, with an average distance travelled of 430,000 kin, or a gain in endurance of approximately 70%. Furthermore, it must be emphasised that the destruction of the tires of the invention did not take place at the level of the reinforcement armature of the carcass (which continued to be strong), but in the reinforcement armature of the crown, which illustrates and confirms the excellent performance of the cables according to the invention.

After decortication, the following results were obtained:

TABLE 3

| | | ΔFm (%) on individual layers and cable | | | |
|---|---|---|---|---|---|
| Tires | Cables | C1 | C2 | C3 | Cable |
| P-III | C-III | 20 | 18 | 9.5 | 13 |
| P-IV | C-IV | 1 | 1 | 3 | 2 |

These results very much confirm those of Table 2 above, even going beyond them, since virtually no deterioration is noted on the cables C-IV of the invention, compared with the control cables C-III, whatever the layer (C1, C2 or C3) in question.

In conclusion, as shown by the tests above, the cables of the invention make it possible to reduce significantly the phenomena of fatigue-fretting corrosion of the cables in the carcass reinforcements of the tires, in particular the heavy-vehicle tires, and thus to improve the longevity of these tires.

Last but not least, it was furthermore noted that these cables according to the invention, owing to their specific construction and probably a very much improved resistance to buckling, imparted to the carcass reinforcements of the tires an endurance which is significantly improved, by a factor of two to three, during travel at reduced pressure.

Example 4

Additional Embodiments

Of course, the invention is not limited to the examples of embodiment described above.

Thus, for example, the inner layer C1 of the cables of the invention might be formed of a wire of non-circular section, for example, one which is plastically deformed, in particular a wire of substantially oval or polygonal section, for example triangular, square or alternatively rectangular; the layer C1 might also be formed of a preformed wire, whether or not of circular section, for example an undulating or corkscrewed wire, or one twisted into the shape of a helix or a zigzag. In such cases, it should of course be understood that the diameter $d_1$ of the layer C represents the diameter of the imaginary cylinder of revolution which surrounds the central wire (diameter of bulk), and not the diameter (or any other transverse size, if its section is not circular) of the central wire itself. The same would apply if the layer C1 were formed not of a single wire as in the previous examples, but of several wires assembled together, for example of two wires arranged in parallel to one another or alternatively twisted together, in a direction of twist identical or not identical to that of the intermediate layer C2.

For reasons of industrial feasibility, cost and overall performance, it is however preferred to implement the invention with a single conventional linear central wire (layer C1), of substantially circular section.

Furthermore, since the central wire is less stressed during the cabling operation than the other wires, bearing in mind its position in the cable, it is not necessary for this wire to use, for example, steel compositions which offer high ductility in torsion; advantageously any type of steel may be used, for example a stainless steel.

Furthermore, (at least) one linear wire of one of the two layers C2 and/or C3 might also be replaced by a preformed or deformed wire, or more generally by a wire of section different from that of the other wires of diameter $d_2$ and/or $d_3$, so as, for example, to improve still further the ability of the cable to be penetrated by rubber or any other material, the diameter of bulk of this replacement wire possibly being less than, equal to or greater than the diameter ($d_2$ and/or $d_3$) of the other wires constituting the layer (C2 and/or C3) in question.

Without modifying the spirit of the invention, all or some of the wires constituting the cable according to the invention might be constituted of wires other than steel wires, whether metallic or not, in particular wires of inorganic or organic material having high mechanical strength, for example monofilaments of liquid-crystal organic polymers.

The invention also relates to any multi-strand steel cable ("multi-strand rope"), the structure of which incorporates, at least, as the elementary strand, a three-layered cable according to the invention.

What is claimed is:

1. A multi-strand steel cable comprising, as an elementary strand, a three-layered cable, wherein the three-layered cable includes:

an inner layer C1, which includes from 1 to 4 wires L having a diameter $d_1$;

an intermediate layer C2, which surrounds the inner layer C1, wherein the intermediate layer C2 includes from 3 to 12 wires M having a diameter $d_2$, and wherein the wires M are wound together in a helix at a pitch $p_2$;

an outer layer C3, which surrounds the intermediate layer C2, wherein the outer layer C3 includes from 8 to 20 wires N having a diameter $d_3$, wherein the wires N are wound together in a helix at a pitch $p_3$, and wherein the wires M of the intermediate layer C2 and the wires N of the outer layer C3 are wound in a same direction of twist; and at least one of: a first rubber sheath, which is positioned between the inner layer C1 and the intermediate layer C2, and a second rubber sheath, which is positioned between the intermediate layer C2 and the outer layer C3, wherein the first and second rubber sheaths are formed of a cross-linkable or cross-linked rubber composition that includes at least one diene elastomer.

2. A multi-strand steel cable according to claim 1, wherein the at least one diene elastomer of the rubber sheath is selected from a group of elastomers that includes polybutadienes, natural rubbers, synthetic polyisoprenes, butadiene copolymers, isoprene copolymers, and mixtures thereof.

3. A multi-strand steel cable according to claim 2, wherein the at least one diene elastomer is selected from a group of elastomers that includes natural rubbers, synthetic polyisoprenes, and mixtures thereof.

4. A multi-strand steel cable according to claim 3, wherein the at least one diene elastomer is a natural rubber.

5. A multi-strand steel cable according to claim 1, wherein the rubber composition includes carbon black as a reinforcing filler.

6. A multi-strand steel cable according to claim 1, wherein the rubber composition has, in a cross-linked state, a secant tensile modulus that is less than 20 MPa.

7. A multi-strand steel cable according to claim 6, wherein the secant tensile modulus is less than 12 MPa.

8. A multi-strand steel cable according to claim 1, wherein the steel cable is incorporated into a carcass reinforcement ply of a tire that includes a rubber matrix, and wherein the rubber matrix of the carcass reinforcement ply includes substantially a same rubber composition as the rubber composition of each of the first and second rubber sheaths of the three-layered cable.

9. A multi-strand steel cable according to claim 1, wherein the outer layer C3 is a saturated layer.

10. A multi-strand steel cable according to claim 1, wherein the first rubber sheath covers the inner layer C1.

11. A multi-strand steel cable according to claim 1, wherein the first rubber sheath is structured to separate adjacent wires of the wires M in the intermediate layer C2.

12. A multi-strand steel cable according to claim 1, wherein the second rubber sheath separates adjacent wires of the wires N of the outer layer C3 and covers a radial inner half-circumference of each wire N of the outer layer C3.

13. A multi-strand steel cable according to claim 1, wherein the intermediate layer C2 includes 6 or 7 of the wires M.

14. A multi-strand steel cable according to claim 1, wherein:

$0.10\ \text{mm} < d_1 < 0.28\ \text{mm}$;

$0.10\ \text{mm} < d_2 < 0.25\ \text{mm}$;

$0.10\ \text{mm} < d_3 < 0.25\ \text{mm}$;

M=6 or M=7; and $5\pi(d_1+d_2) < p_2 \leq p_3 < 5\pi(d_1+2d_2+d_3)$.

15. A multi-strand steel cable according to claim 14, wherein:

if M is 6, then a ratio ($d_1/d_2$) is from 1.10 to 1.40; and if M is 7, then the ratio ($d_1/d_2$) is from 1.40 to 1.70.

16. A multi-strand steel cable according to claim 15, wherein $p_2 = p_3$.

17. A multi-strand steel cable according to claim 16, wherein the outer layer C3 has a substantially circular cross-section.

18. A multi-strand steel cable according to claim 1, wherein the inner layer C1 includes 1 wire L.

19. A multi-strand steel cable according to claim 18, wherein a wire composition of the three-layered cable includes one of:

6 wires for the wires M in the intermediate layer C2, and 10 wires for the wires N in the outer layer C3;

6 wires for the wires M in the intermediate layer C2, and 11 wires for the wires N in the outer layer C3;

6 wires for the wires M in the intermediate layer C2, and 12 wires for the wires N in the outer layer C3;

7 wires for the wires M in the intermediate layer C2, and 11 wires for the wires N in the outer layer C3;

7 wires for the wires M in the intermediate layer C2, and 12 wires for the wires N in the outer layer C3; and 7 wires for the wires M in the intermediate layer C2, and 13 wires for the wires N in the outer layer C3.

20. A multi-strand steel cable according to claim 19, wherein the intermediate layer C2 includes 6 wires for the wires M, and the outer layer C3 includes 12 wires for the wires N.

21. A multi-strand steel cable according to claim 14, wherein:

$0.18\ \text{mm} < d_1 < 0.24\ \text{mm}$;

$0.16\ \text{mm} < d_2 \leq d_3 < 0.19\ \text{mm}$; and $5\ \text{mm} < p_2 \leq p_3 < 12\ \text{mm}$.

22. A multi-strand steel cable according to claim 14, wherein:

$0.18\ \text{mm} < d_1 < 0.24\ \text{mm}$;

$0.16\ \text{mm} < d_2 \leq d_3 < 0.19\ \text{mm}$; and $20\ \text{mm} < p_2 \leq p_3 < 30\ \text{mm}$.

23. A multi-strand steel cable according to claim 1, wherein each of the first and second rubber sheaths has an average thickness of from 0.010 mm to 0.040 mm.

24. A multi-strand steel cable according to claim 1, wherein the wire or wires L, the wires M, and the wires N include carbon steel.

25. A multi-strand steel cable according to claim 24, wherein a carbon content of the carbon steel is from 0.4% to 1.0%.

* * * * *